US007618270B2

(12) United States Patent
Scherer et al.

(10) Patent No.: US 7,618,270 B2
(45) Date of Patent: Nov. 17, 2009

(54) ELECTRICAL CONNECTOR

(75) Inventors: Richard J. Scherer, Austin, TX (US); Joseph N. Castiglione, Cedar Park, TX (US); Ronald K. Revell, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/017,982

(22) Filed: Jan. 22, 2008

(65) Prior Publication Data

US 2008/0176432 A1 Jul. 24, 2008

Related U.S. Application Data

(60) Provisional application No. 60/886,229, filed on Jan. 23, 2007.

(51) Int. Cl.
*H01R 13/62* (2006.01)

(52) U.S. Cl. ..... 439/152; 439/160

(58) Field of Classification Search ..... 439/152, 439/155, 157, 160
See application file for complete search history.

(56) References Cited

U.S. PATENT DOCUMENTS

| | | | | |
|---|---|---|---|---|
| 4,233,646 | A * | 11/1980 | Leung et al. | 361/752 |
| 4,780,792 | A * | 10/1988 | Harris et al. | 361/737 |
| 4,911,647 | A * | 3/1990 | Ferchau et al. | 439/157 |
| 5,302,133 | A | 4/1994 | Tondreault | |
| 5,364,282 | A | 11/1994 | Tondreault | |
| 5,429,523 | A | 7/1995 | Tondreault | |
| 5,603,625 | A | 2/1997 | Tondreault | |
| 5,775,925 | A | 7/1998 | Tondreault | |
| 5,928,015 | A | 7/1999 | Tondreault | |
| 6,767,233 | B2 | 7/2004 | Tsunematsu | |
| 6,981,886 | B1 * | 1/2006 | Co et al. | 439/160 |
| 7,029,297 | B1 * | 4/2006 | Co et al. | 439/152 |

FOREIGN PATENT DOCUMENTS

| | | | |
|---|---|---|---|
| JP | 08-279378 | A2 | 10/1996 |
| JP | 11-307198 | A2 | 11/1999 |
| JP | 13-307829 | A2 | 11/2001 |
| JP | 14-329536 | A2 | 11/2002 |

OTHER PUBLICATIONS

Product Literature: 3M™ Pak 50 4-Wall, Tripolarized Header, 810 Series, Date Modified: Apr. 1, 2005, found online at <http://www.3M.com/interconnects/>, 4 pages.

* cited by examiner

*Primary Examiner*—Tho D Ta
(74) *Attorney, Agent, or Firm*—Johannes P. M. Kusters

(57) ABSTRACT

An electrical connector includes a connector housing, a plurality of electrical contacts, and an ejector mechanism coupled to an end of the connector housing. The ejector mechanism has means for ejecting a mating connector out of the connector housing upon movement of the ejector mechanism relative to the connector housing and means for releasably locking a mating connector in the electrical connector. The ejector mechanism is configured to be positioned in at least three stop positions, and optionally includes at least one interference feature configured to define a stop position allowing insertion of a mating connector. The electrical connector can be part of an electrical connector system.

15 Claims, 6 Drawing Sheets

ELECTRICAL CONNECTOR

CROSS REFERENCE TO RELATED APPLICATIONS

The present application claims priority to U.S. Provisional Patent Application 60/886,229, filed Jan. 23, 2007.

TECHNICAL FIELD

The present invention relates to an electrical connector having an ejector mechanism for removing a mating connector from the electrical connector. More particularly, the ejector mechanism includes means for releasably locking the mating connector to the electrical connector.

BACKGROUND

Electrical connectors are used in a variety of applications for making electrical interconnections. A connector typically includes at least two components: a housing or other body member and a plurality of terminals or electrical contact elements positioned in the housing. A connector may be attached to the end of a multi-conductor cable, and a mating connector may be mechanically and electrically interconnected to a printed circuit board, or both connectors may be connected to cables or a pair of printed circuit boards. Regardless of the application, electrical connectors often are difficult to mate or interconnect when they mount a large number of terminals.

With the increasing use of electrical and electronic components in a wide variety of consumer products, the provision of reliable electrical connections to and between such components has become increasingly difficult, for not only are larger numbers of components being used, but the components are becoming more complex, requiring larger numbers of wires and connectors, and are becoming smaller to accommodate miniaturization of the electronics, which is reducing available board space in many consumer products. All of these factors combine to magnify the problem of installing, replacing, or repairing the electronic components.

To facilitate the installation, replacement, and repair of the electrical components, it is well known to use an ejector mechanism to releasably lock mating connectors to each other as well as separate them from each other. As a result of the miniaturization of electrical connectors, a common problem is the damage or breakage of the ejector mechanism or the connector housing of the electrical connectors during normal operation of the ejector mechanism or during insertion or extraction of the mating connector. A common solution is to structurally reinforce areas of the ejector mechanism or connector housing susceptible to operational damage. However, the structural reinforcement of areas of the ejector mechanism or connector housing typically results in an increase in size and/or cost of the electrical connector.

SUMMARY

At least one aspect of the present invention pertains to an electrical connector having one or more ejector mechanisms designed to prevent damage or breakage of the ejector mechanism or the connector housing of the electrical connector during normal operation while supporting the continuing miniaturization of electrical connectors.

In one aspect, the present invention provides an electrical connector comprising a connector housing configured to receive a mating connector and including a plurality of electrical contacts for engaging a plurality of contacts of the mating connector, and an ejector mechanism coupled to an end of the connector housing. The ejector mechanism includes means for ejecting a mating connector out of the connector housing upon movement of the ejector mechanism relative to the connector housing and means for releasably locking the mating connector in the electrical connector, wherein the ejector mechanism is configured to be positioned in at least three stop positions. Optionally, the ejector mechanism includes at least one interference feature configured to define a stop position allowing insertion of a mating connector.

In another aspect, the present invention provides an ejector mechanism for use in an electrical connector having a connector housing configured to receive a mating connector and a plurality of electrical contacts for engaging a plurality of contacts of the mating connector. The ejector mechanism comprises means for ejecting a mating connector out of the connector housing upon movement of the ejector mechanism relative to the connector housing and means for releasably locking the mating connector in the electrical connector, wherein the ejector mechanism is configured to be positioned in at least three stop positions. Optionally, the ejector mechanism includes at least one interference feature configured to define a stop position allowing insertion of a mating connector.

In yet another aspect, the present invention provides an electrical connector system including an electrical connector and a mating connector configured to be electrically connected to the electrical connector. The electrical connector comprises a connector housing configured to receive a mating connector and including a plurality of electrical contacts for engaging a plurality of contacts of the mating connector, and an ejector mechanism coupled to an end of the connector housing. The ejector mechanism includes means for ejecting a mating connector out of the connector housing upon movement of the ejector mechanism relative to the connector housing and means for releasably locking the mating connector in the electrical connector, wherein the ejector mechanism is configured to be positioned in at least three stop positions. Optionally, the ejector mechanism includes at least one interference feature configured to define a stop position allowing insertion of a mating connector.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description, reference is made to the accompanying drawings that form a part hereof. The accompanying drawings show, by way of illustration, specific embodiments in which the invention may be practiced. It is to be understood that other embodiments may be utilized, and that structural or logical changes may be made without departing from the scope of the present invention. The following detailed description, therefore, is not to be taken in a limiting sense, and the scope of the invention is defined by the appended claims.

Figure 1:
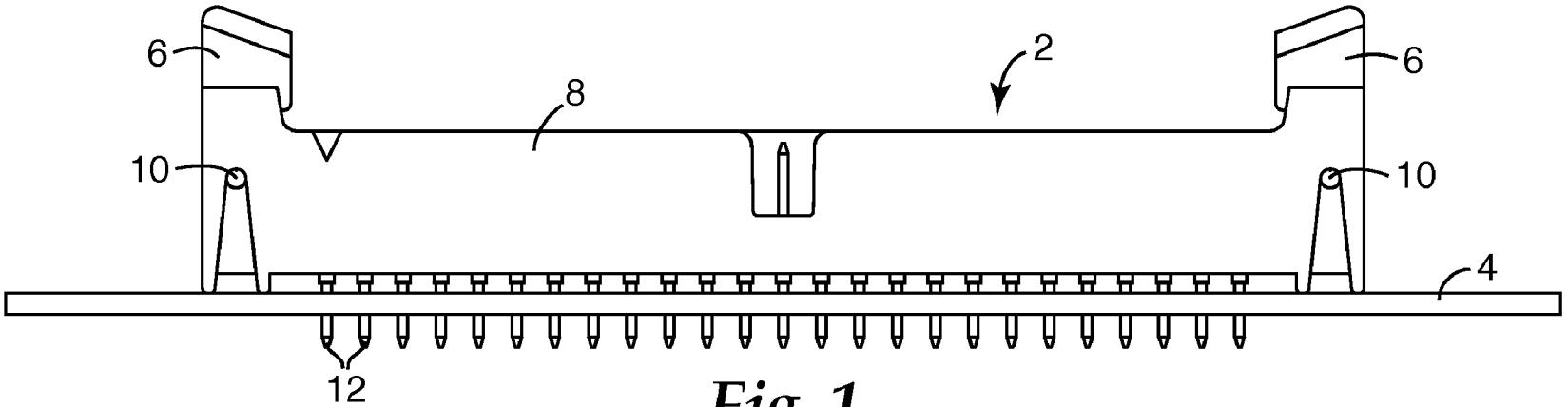
FIG. 1 is a front view of an exemplary embodiment of an electrical connector according to the present invention showing the ejector mechanisms in a stop position releasably locking a mating connector (not shown) in the electrical connector.

Referring now to the figures, FIG. 1 illustrates an exemplary embodiment of an electrical connector according to the present invention. It shows electrical connector 2 mounted on printed circuit board 4. Electrical connector 2 includes two ejector mechanisms 6 positioned in a stop position for releasably locking a mating connector (not shown) in electrical connector 2. In this stop position, the major axes of ejector mechanisms 6 are positioned substantially perpendicular to the major axis of connector housing 8 of electrical connector 2. In this embodiment, ejector mechanisms 6 are pivotably connected to the ends of connector housing 8 by pivot pins 10. Electrical connector 2 further includes a plurality of electrical contacts 12 configured to engage a plurality of contacts of a mating connector (not shown) as well as printed circuit board 4. Although this exemplary embodiment shows two ejector mechanisms, electrical connectors may have one or more ejector mechanisms to best suit the application.

Figure 2:
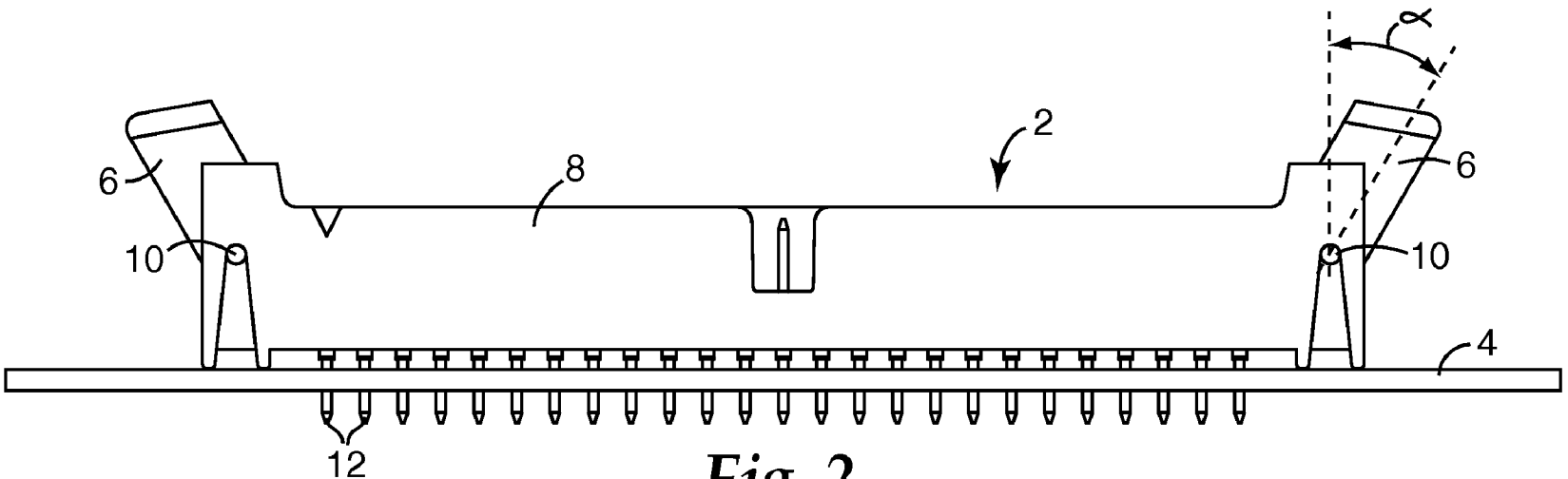
FIG. 2 is a front view of the electrical connector of FIG. 1 showing the ejector mechanisms in a stop position allowing insertion of a mating connector (not shown).
Figure 4D:
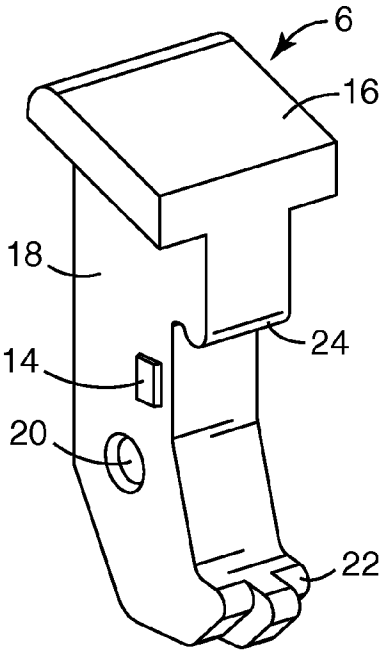
FIGS. 4A-4D are front, top, side, and perspective views respectively of an exemplary embodiment of an ejector mechanism according to the present invention.
Figure 4C:
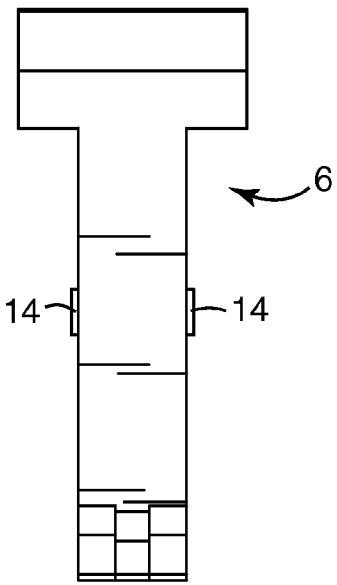
Figure 4B:
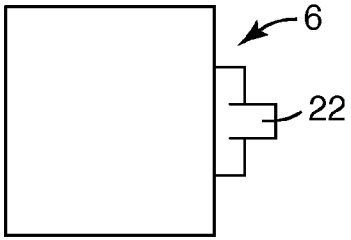
Figure 4A:
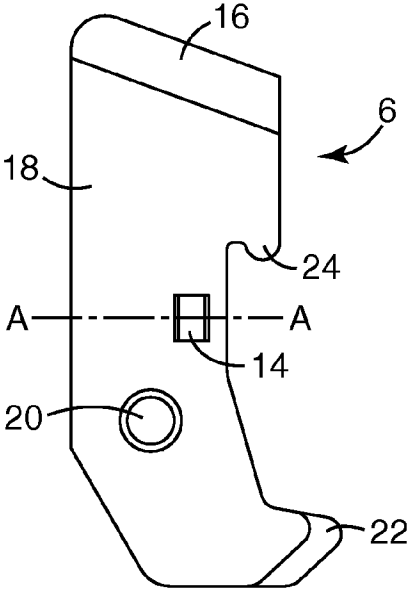

FIG. 2 illustrates the electrical connector shown in FIG. 1, wherein ejector mechanisms 6 are positioned in a stop position allowing insertion of a mating connector (not shown). This stop position is defined by the frictional engagement of interference features 14 located on ejector mechanisms 6 with the inner walls of connector housing 8. Interference feature 14 is best shown in FIG. 4D and properly positions ejector mechanisms 6 for adequate placement of a mating connector thereby enabling its proper engagement and latching with electrical connector 2.

Figure 3:
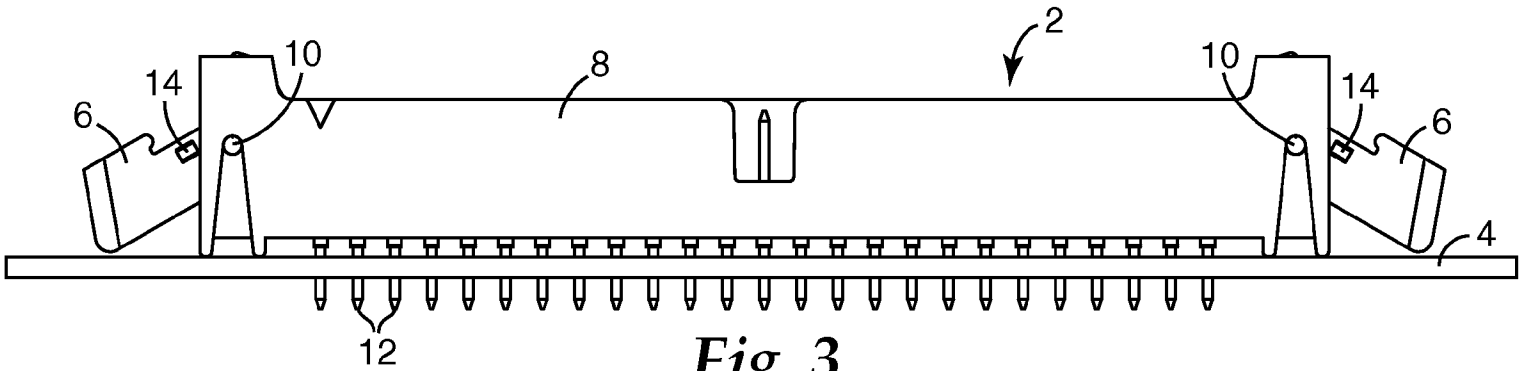
FIG. 3 is a front view of the electrical connector of FIG. 1 showing the ejector mechanisms in a stop position defined by a printed circuit board.

FIG. 3 illustrates the electrical connector shown in FIGS. 1 and 2, wherein ejector mechanisms 6 are positioned in a stop position defined by printed circuit board 4. This stop position can be obtained by pushing ejector mechanisms 6 beyond the point at which interference features 14 frictionally engage with the inner walls of connector housing 8. Typical ejector mechanisms do not allow for travel of ejector mechanisms 6 beyond the stop position allowing insertion of a mating connector (as shown in FIG. 2). Typical existing ejector mechanisms have stop features instead of the interference features of the present invention. The stop features typically are protrusions large enough to prevent the ejector mechanism from moving past the point where the stop feature contacts an inner surface of connector housing 8. With this configuration, normal operation of the ejector mechanism or insertion or extraction of the mating connector could then cause damage or breakage of the ejector mechanism, such as shearing/snapping off of the stop features, or the connector housing of the electrical connector, e.g. if over-ejection occurs. The ability to push ejector mechanisms 6 beyond their interference features 14 into a stop position defined by printed circuit board 4 as in the present invention avoids this potential damage or breakage.

FIGS. 4A-4D illustrate an exemplary embodiment of an ejector mechanism according to the present invention. Ejector mechanism 6 can be made of plastic, metal, or other suitable material. It can vary in size and shape to best suit the application. It includes interference features 14 for defining the stop position allowing insertion of a mating connector. The interference features can vary in quantity, size, and shape to best suit the application. In this embodiment, interference features 14 appear on both sides of the ejector mechanism. Additional interference features may be incorporated to create additional stop positions, e.g. to define a position of the ejector mechanism when the connector is sealed in a tape and reel package or for pick and place consistency. The size and shape of the interference features determine the amount of interference between the ejector mechanism and the connector housing and ultimately the amount of force it takes to push the interference features beyond the connector housing to place the ejector mechanism in a stop position defined by printed circuit board 4. In the exemplary embodiment of an electrical connector illustrated in FIGS. 2-4, the amount of interference between ejector mechanism 6 and connector housing 8 is about 0.50 mm (0.020"). In comparable electrical connector applications, the amount of interference can vary from about 0.25 mm (0.010") to about 2.00 mm (0.080"), and the amount of force it takes to push the interference features beyond the connector housing can vary from about 13N (3 lbf) to about 22N (5 lbf). Exemplary shapes of interference feature cross-section A-A include but are not limited to semi-circular, trapezoidal, and rectangular. Exemplary profiles of interference features from a top view include but are not limited to circular and rectangular. Interference features 14 can be positioned on ejector mechanism 6 to best suit the application. The position of the interference features determines the angle of ejector mechanism 6 relative to connector housing 8 when ejector mechanism is in an intermediate stop position such as shown in FIG. 2. Selection of this angle is determined by the required position of the ejector mechanism, e.g., for proper positioning of the mating connector or to accommodate tape and reel packaging dimensions or obtain consistency in pick and place handling. In electrical connector applications of the present invention, the angle of ejector mechanism 6 relative to connector housing 8, shown in FIG. 2 as angle $\alpha$, can vary from 0° in the stop position releasably locking the mating connector in the electrical connector to 180° in the stop position defined by the printed circuit board to which the connector is attached. In some embodiments, angle $\alpha$ will be between about 15° and 45° in the stop position allowing insertion of the mating connector and between about 105° and 135° in the stop position defined by the printed circuit board to which the connector is attached. In one exemplary embodiment, angle $\alpha$ is about 30° in the stop position allowing insertion of the mating connector and about 120° in the stop position defined by the printed circuit board to which the connector is attached. Ejector mechanism 6 further includes head 16 formed integrally with body portion 18 to facilitate pivotal movement of ejector mechanism 6 about pivot pin 10. Head 16 provides a "finger shelf" on which to push when actuating ejector mechanism 6. Pivot hole 20 is formed in body portion 18 to receive pivot pin 10. Pivot hole 20 and pivot pin 10 define a pivot axis perpendicular to connector housing 8 of electrical connector 2. Ejector mechanism 6 further includes ejector portion 22 configured for engaging an end portion of a mating connector (not shown) adjacent ejector mechanism 6 to eject the mating connector out of connector housing 8 upon movement of ejector mechanism 6 relative to connector housing 8. In addition, ejector mechanism 6 includes latch portion 24 for releasably locking a mating connector (not shown) in electrical connector 2.

Figure 5C:
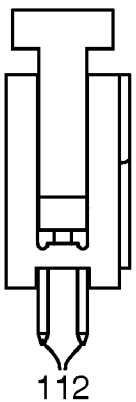
FIGS. 5A-5C are front, top, and side views respectively of an exemplary embodiment of an electrical connector according to the present invention.
Figure 5B:
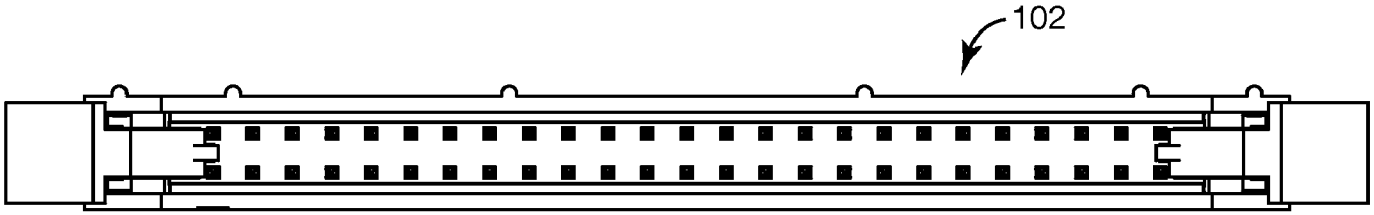
Figure 5A:
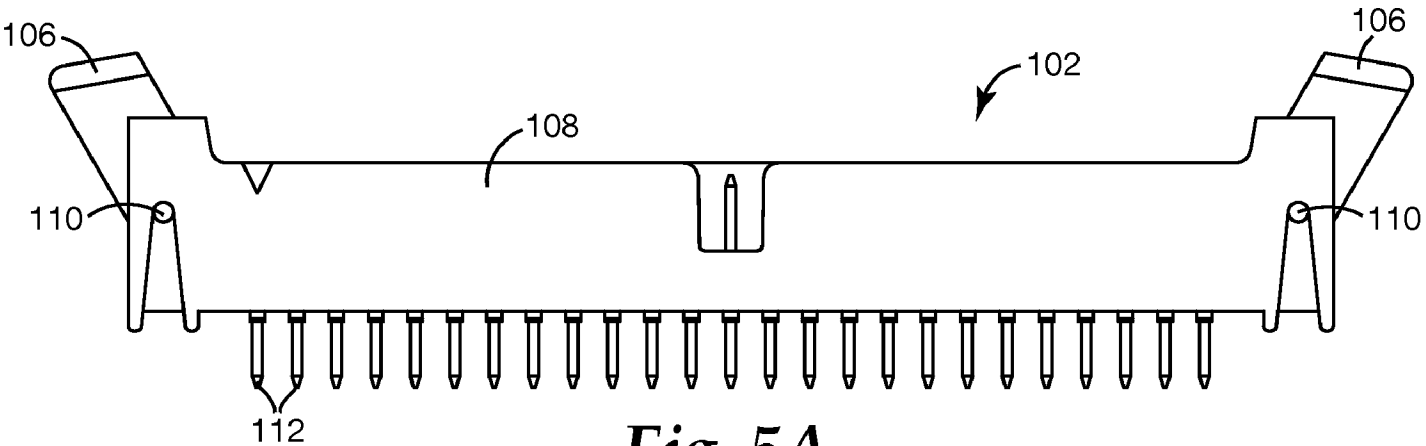

FIGS. 5A-5C illustrate another exemplary embodiment of an electrical connector according to the present invention. Electrical connector 102 includes two ejector mechanisms 106 positioned in a stop position allowing insertion of a mating connector (not shown). In this embodiment, ejector mechanisms 106 are pivotably connected to the ends of connector housing 108 by means of pivot pins 110 and can be positioned in the three stop positions described above. Electrical connector 102 further includes a plurality of electrical contacts 112 configured to engage a plurality of contacts of a mating connector (not shown) as well as a printed circuit board (not shown). Electrical contacts 112 are straight contacts allowing vertical mounting of electrical connector 102 onto a printed circuit board either by conventional soldering or press-fit technology.

Figure 6C:
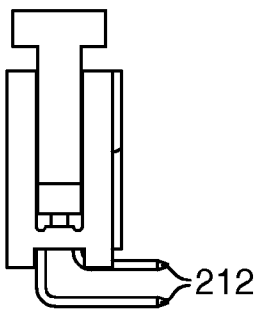
FIGS. 6A-6C are front, top, and side views respectively of another exemplary embodiment of an electrical connector according to the present invention.
Figure 6B:
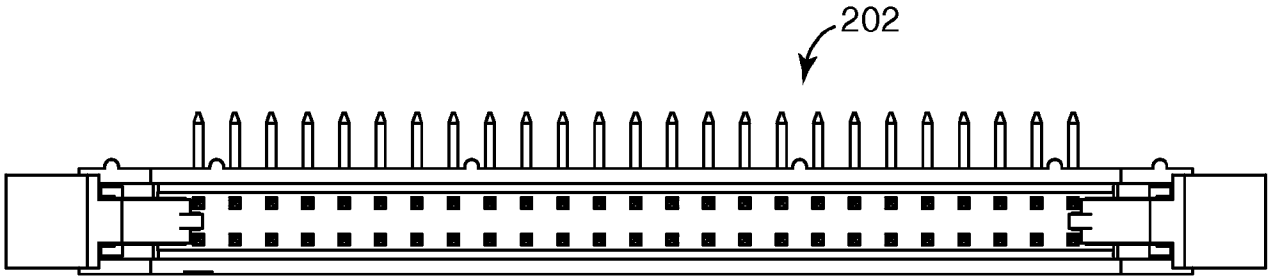
Figure 6A:
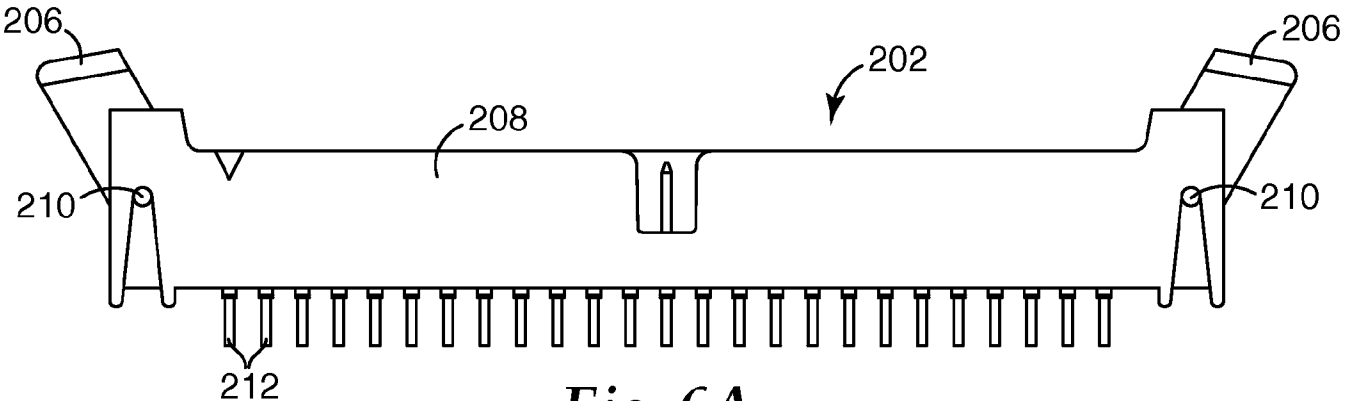

FIGS. 6A-6C illustrate another exemplary embodiment of an electrical connector according to the present invention. Electrical connector 202 includes two ejector mechanisms 206 positioned in a stop position allowing insertion of a mating connector (not shown) as well as a printed circuit board (not shown). In this embodiment, ejector mechanisms 206 are pivotably connected to the ends of connector housing 208 by means of pivot pins 210 and can be positioned in the three stop positions described above. Electrical connector 202 further includes a plurality of electrical contacts 212 configured to engage a plurality of contacts of a mating connector (not shown) as well as a printed circuit board (not shown). Electrical contacts 212 are right angle contacts allowing horizontal mounting of electrical connector 202 onto a printed circuit board either by conventional soldering or press-fit technology.

Figure 7C:
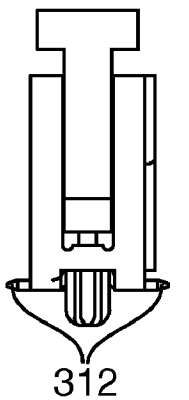
FIGS. 7A-7C are front, top, and side views respectively of another exemplary embodiment of an electrical connector according to the present invention.
Figure 7B:
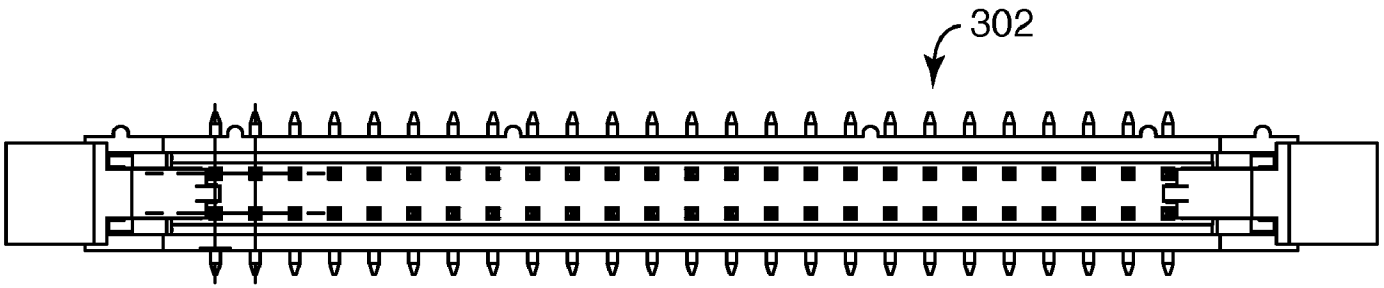
Figure 7A:
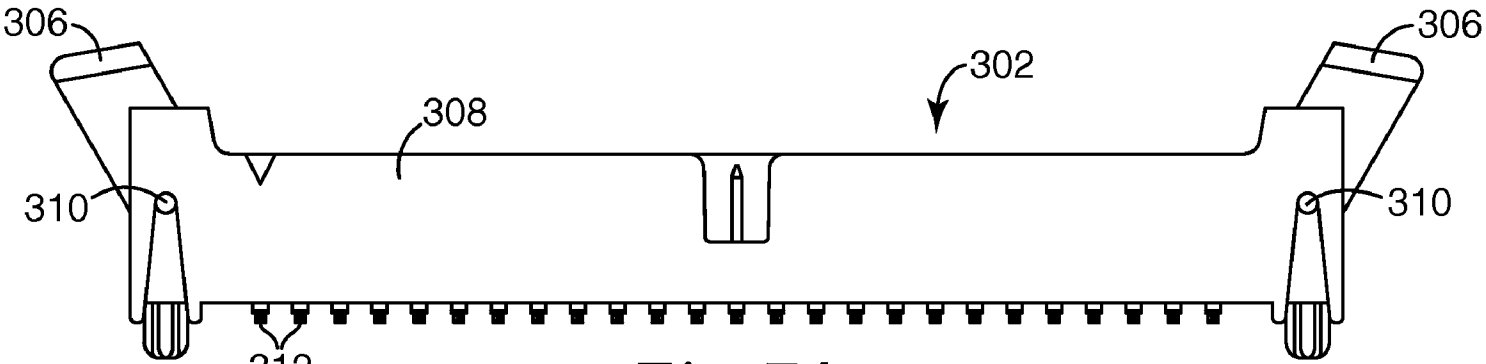

FIGS. 7A-7C illustrate another exemplary embodiment of an electrical connector according to the present invention. Electrical connector 302 includes two ejector mechanisms 306 positioned in a stop position allowing insertion of a mating connector (not shown). In this embodiment, ejector mechanisms 306 are pivotably connected to the ends of connector housing 308 by means of pivot pins 310 and can be positioned in the three stop positions described above. Electrical connector 302 further includes a plurality of electrical contacts 312 configured to engage a plurality of contacts of a mating connector (not shown) as well as a printed circuit board (not shown). Electrical contacts 312 are surface mount contacts allowing vertical mounting of electrical connector 302 onto a printed circuit board by conventional soldering or other known surface mount technologies.

It is to be understood that types of electrical contact other than the ones described above may be applied. For example, the electrical contacts can be right angle surface mount contacts allowing horizontal mounting of the electrical connector onto a printed circuit board by conventional soldering or other known surface mount technologies.

Figure 8:
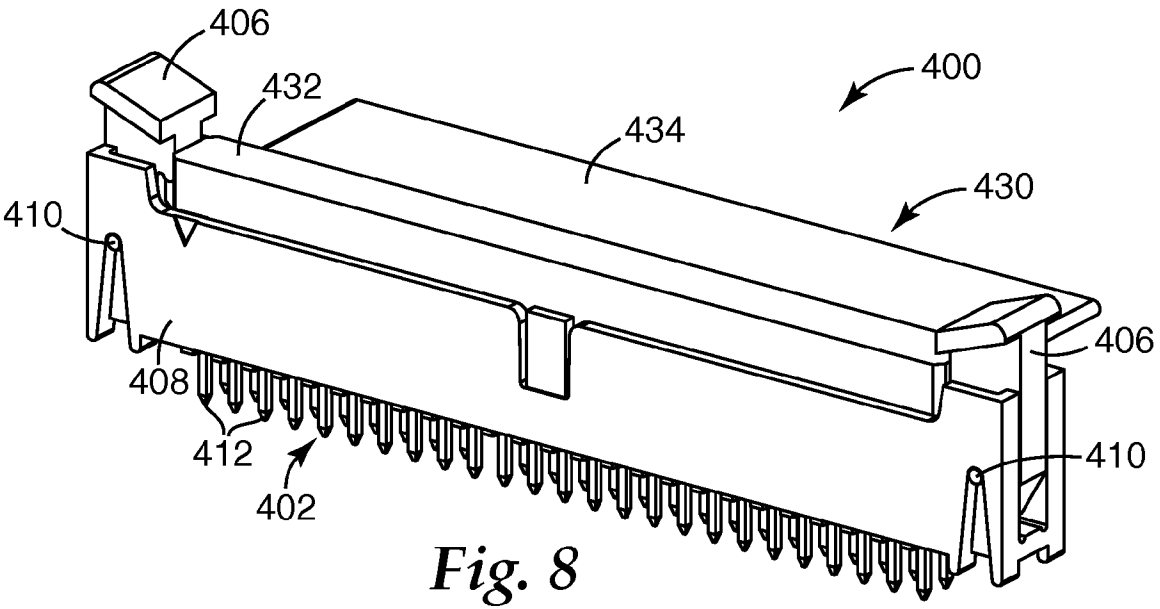
FIG. 8 is a perspective view of an exemplary embodiment of an electrical connector system according to the present invention.

FIG. 8 illustrates an exemplary embodiment of an electrical connector system according to the present invention. Electrical connector system 400 includes electrical connector 402 having two ejector mechanisms 406 positioned in a stop position releasably locking mating connector 430 in electrical connector 402. In this stop position, ejector mechanisms 406 are positioned substantially perpendicular to the major axis of connector housing 408 of electrical connector 402. In this embodiment, ejector mechanisms 406 are pivotably connected to the ends of connector housing 408 by means of pivot pins 410 and can be positioned in the three stop positions described above. Electrical connector 402 further includes a plurality of electrical contacts 412 configured to engage a plurality of contacts (not shown) of mating connector 430 as well as a printed circuit board (not shown). Mating connector 430 is a cable connector including mating connector housing 432 and electrical cable 434. Mating connector housing 432 includes a plurality of electrical contacts (not shown) configured to be electrically connected to electrical contacts 412 of electrical connector 402. Electrical cable 434 can be attached to the electrical contacts of mating connector 430 by known methods, such as insulation displacement. Mating connector housing 432 can be a two-part housing, wherein a first part positions the electrical contacts of mating connector 430 and a second part is pressed onto the first part to enclose the connections of the electrical contacts of mating connector 430 and electrical cable 434. In another embodiment, mating connector housing 432 can be a two-part housing, wherein a first part positions the electrical contacts of mating connector 430 and a second part is injection molded onto the first part to enclose the connections of the electrical contacts of mating connector 430 and electrical cable 434.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electromechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical connector comprising:

a connector housing configured to receive a mating connector and including a plurality of electrical contacts for engaging a plurality of contacts of the mating connector; and a monolithic ejector mechanism coupled to an end of the connector housing, the ejector mechanism comprising:

means for ejecting a mating connector out of the connector housing upon movement of the ejector mechanism relative to the connector housing;

means for releasably locking the mating connector in the electrical connector; and at least one interference feature, wherein the ejector mechanism is configured to be positioned in at least three stop positions, and wherein one of the stop positions is a stop position allowing insertion of the mating connector and is defined by frictional engagement of the interference feature and the connector housing.

2. The electrical connector of claim 1, wherein one of the stop positions is a stop position releasably locking the mating connector in the electrical connector.

3. The electrical connector of claim 1, wherein one of the stop positions is a stop position defined by a printed circuit board to which the connector is attached.

4. electrical connector of claim 1, wherein the electrical connector is a header.

5. The electrical connector of claim 1, wherein the mating connector is a cable connector.

6. The electrical connector of claim 1, wherein the mating connector is a socket.

7. A monolithic ejector mechanism for use in an electrical connector having a connector housing configured to receive a mating connector and a plurality of electrical contacts for engaging a plurality of contacts of the mating connector, the ejector mechanism comprising:

means for ejecting a mating connector out of the connector housing upon movement of the ejector mechanism relative to the connector housing;

means for releasably locking the mating connector in the electrical connector; and at least one interference feature, wherein the ejector mechanism is configured to be positioned in at least three stop positions, and wherein one of the stop positions is a stop position allowing insertion of the mating connector and is defined by frictional engagement of the interference feature and the connector housing.

8. The ejector mechanism of claim 7, wherein one of the stop positions is a stop position releasably locking the mating connector in the electrical connector.

9. ejector mechanism of claim 7, wherein one of the stop positions is a stop position defined by a printed circuit board to which the connector is attached.

10. An electrical connector system comprising:

an electrical connector comprising:

a connector housing configured to receive a mating connector and including a plurality of electrical contacts for engaging a plurality of contacts of the mating connector; and a monolithic ejector mechanism coupled to an end of the connector housing, the ejector mechanism comprising:

means for ejecting a mating connector out of the connector housing upon movement of the ejector mechanism relative to the connector housing;

means for releasably locking the mating connector in the electrical connector; and at least one interference feature, wherein the ejector mechanism is configured to be positioned in at least three stop positions; and a mating connector configured to be electrically connected to the electrical connector, wherein one of the stop positions is a stop position allowing insertion of the mating connector and is defined by frictional engagement of the interference feature and the connector housing.

11. The electrical connector system of claim 10, wherein one of the stop positions is a stop position releasably locking the mating connector in the electrical connector.

12. The electrical connector system of claim 10, wherein one of the stop positions is a stop position defined by a printed circuit board to which the connector is attached.

13. The electrical connector system of claim 10, wherein the electrical connector is a header.

14. The electrical connector system of claim 10, wherein the mating connector is a cable connector.

15. The electrical connector system of claim 10, wherein the mating connector is a socket.

* * * * *

UNITED STATES PATENT AND TRADEMARK OFFICE

CERTIFICATE OF CORRECTION

PATENT NO. : 7,618,270 B2
APPLICATION NO. : 12/017982
DATED : November 17, 2009
INVENTOR(S) : Richard J Scherer It is certified that error appears in the above-identified patent and that said Letters Patent is hereby corrected as shown below:

Column 6,
Lines 21-22, delete "electromechanical," and insert --electro-mechanical,-- therefor.

Line 57, Claim 4, before "electrical" insert --The--.

Column 7,
Line 16, Claim 9, before "ejector" insert --The--.

Signed and Sealed this

Second Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,618,270 B2
APPLICATION NO. : 12/017982
DATED : November 17, 2009
INVENTOR(S) : Richard J. Scherer It is certified that error appears in the above-identified patent and that said Letters Patent is hereby corrected as shown below:

Title Page, Item [*] Notice:

The phrase "by 0 days" shall reflect as such appears on Letters Patent.

Signed and Sealed this
Eighth Day of March, 2011

David J. Kappos

David J. Kappos
*Director of the United States Patent and Trademark Office*